US005701149A

United States Patent [19]

Pagnon et al.

[11] Patent Number: 5,701,149

[45] Date of Patent: Dec. 23, 1997

[54] METHOD TO OPTIMIZE THE OPERATION OF AN INK-JET PRINTER, AND A PRINTER USING SUCH A METHOD

[75] Inventors: Alain Pagnon, Bourg les Valence; Pierre Rieuvernet, Valence, both of France

[73] Assignee: Imaje, Bourg les Valence, France

[21] Appl. No.: 538,854

[22] Filed: Oct. 4, 1995

Related U.S. Application Data

[63] Continuation of Ser. No. 52,923, Apr. 27, 1993, abandoned.

[30] Foreign Application Priority Data

Apr. 30, 1992 [FR] France ..... 92 05424

[51] Int. Cl.[6] ..... B41J 2/175; B41J 2/18

[52] U.S. Cl. ..... 347/89; 347/17

[58] Field of Search ..... 347/89, 74, 17, 347/23, 35, 90, 75

[56] References Cited

U.S. PATENT DOCUMENTS 4,364,055 12/1982 Aiba .

FOREIGN PATENT DOCUMENTS 0076914 4/1983 European Pat. Off. .
0228828 7/1987 European Pat. Off. .
2545042 11/1984 France .
57-51473 3/1982 Japan .
58-96561 6/1983 Japan .

*Primary Examiner*—Valerie Lund
*Attorney, Agent, or Firm*—William L. Feeney; Kerkam, Stowell, Kondracki & Clarke, P.C.

[57] ABSTRACT

Disclosed is a method to optimize the operation of an ink-jet printer provided with a circuit to collect the ink not used for the printing, comprising a gutter connected to an imperviously sealed ink tank by a conduit placed in a state of depression by a constant flow pump checking the flow rate of ink in the conduit by the measurement of the pressure in the ink tank and controlling the operation of the pump either at its minimum suction rate compatible with efficient collection of the ink or at its maximum suction rate during anomalies of collection.

18 Claims, 1 Drawing Sheet

METHOD TO OPTIMIZE THE OPERATION OF AN INK-JET PRINTER, AND A PRINTER USING SUCH A METHOD

This is a continuation of application Ser. No. 08/052,923 filed Apr. 27, 1993, now abandoned.

BACKGROUND OF THE INVENTION

1. Field of the Invention

The present invention relates to a method to optimize the operation of an ink-jet printer as well as to a printer using such a method.

In a deflected continuous flow ink-jet printer, the technique used consists in setting up a continuous jet of calibrated drops of ink sprayed by a printing head, these drops being then charged electrostatically so that certain drops can be deflected by an electrical field. Since the printing device and the medium on which the printing has to be done move in relation to each other, it is thus possible to obtain a matrix of dots printed on the medium. The unused drops of ink are collected in a gutter and then recycled in the ink supply circuit of the printer.

Now, the collection of the unused ink in a gutter is a critical feature in the operation of an ink-jet printer, in order to avoid any smudging on the medium which would result in a deterioration in printing quality. In many applications of this type of printer, among them the industrial marking of bar codes and of corporate symbols, faultless printing quality must be obtained.

2. Description of the Prior Art

At present, there are many solutions for conveying the ink of the unused drops from the gutter to a collecting tank.

An accumulation of ink in the immediate vicinity of the gutter makes it possible to collect the ink in liquid phase, independently of the air which tends to penetrate the gutter between two collected drops or even in being propelled by said drops. The depositing of ink in the vicinity of the gutter can be done by gravity, but a problem arises when the printing head works in every direction of space. Another drawback of this solution lies in the risk that the ink-filled gutter may overflow at the slightest malfunctioning of the printer.

A second technique consists in pushing forward or propelling the ink that is collected in the gutter by Venturi effect, subsequent to a restriction of the conduit immediately downstream with respect to the aperture of the gutter. A propelling fluid is injected into the gutter similarly to a hydro-ejector, but the operating point of such a system is closely related to the ambient conditions of operation of the printer, i.e. those of the temperature and pressure of the ink.

According to a third technique, the ink collected by the gutter is drawn or sucked in by means of a pump which delivers this ink to a collecting tank. To this end, a depression in created in the gutter, slightly greater than the one necessary for the propulsion of the ink. One drawback arises out of the increase in the quantity of air drawn in compared with the quantity of ink drawn in, in the two-phase liquid/gas mixture present in the gutter, leading to over-sizing of the collecting circuit. Furthermore, the optimum operation point of this system is often unknown and variable depending on the conditions of temperature and pressure. The two-phase flow of an incompressible fluid prompts discontinuous and random losses of charge along the collecting conduit due to local collections of liquid, expansion of the gas etc. This means that it is not possible to make a prediction, by means of a model, of the behavior of the ink and hence of the losses of charge to compensate for between the input of the collecting conduit at the gutter output and the collecting tank.

The present invention is aimed at resolving the problems mentioned with respect to the prior art solutions, by proposing a method for the extraction of a two-phase mixture with the lowest possible level of suction compatible with the collection of the entire liquid phase.

SUMMARY OF THE INVENTION

To this end, an object of the invention is a method to optimize the operation of an ink-jet printer comprising a circuit for supplying ink to at least one printing head and a circuit for collecting the ink not used for the printing, comprising a gutter connected to an imperviously sealed tank by a conduit and suction means for drawing in the air located above the ink in the tank in order to set up a depression therein, wherein said method consists in carrying out, firstly, the checking of the rate of collection of the ink by the measurement of the pressure P in the tank, using a sensor, through the detection of any decrease in the pressure P in the tank, indicating an anomaly in the rate of collection of the ink and, secondly, the control of the operation of the suction means either at their minimum suction rate compatible with the nominal rate of collection of the ink or at their maximum suction rate when anomalies are detected in said rate of collection of the ink.

The invention also relates to an ink-jet printer using such a method.

One of the advantages of the invention arises out of the fact that, since the quantity of gas conveyed in the collecting circuit and the energy consumed by the propulsion units are minimal, the lifetime of the printer is extended. This is due to the permanent adapting of the level of suction of the air to the losses of charge observed in real time, in the collection conduit.

BRIEF DESCRIPTION OF THE DRAWINGS

Other features and advantages of the invention shall appear from the following description, illustrated by the figures referred to here below, of which.

MORE DETAILED DESCRIPTION

The elements that fulfil the same functions with a view to obtaining the same results bear the same references in the different figures.

Figure 1:
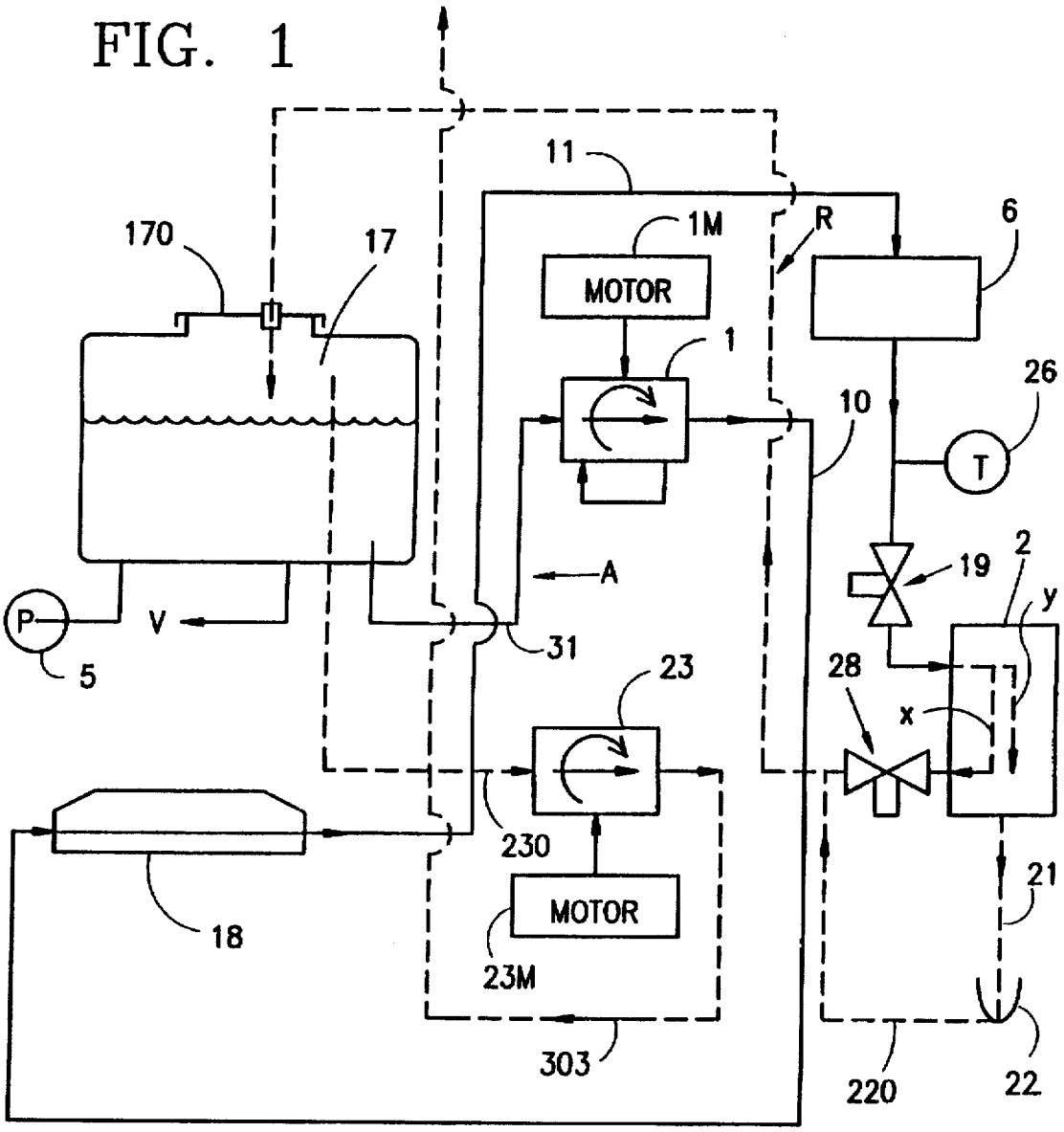
FIG. 1 is a block diagram of an ink supply and collection circuit of a printer according to the invention.

FIG. 1 is a schematic block diagram of an ink supply and collection circuit of a deflected continuous flow ink-jet printer according to a non-limitative embodiment, as described in the published French patent application No. 2 545 042, filed by the Applicant. In this embodiment, the continuous flow jet printer, designed to spray a jet 21 of ink drops from a printing head 2 on to a medium that is moving past below, comprises a circuit A used to supply the printing head 2 by connecting an imperviously sealed ink tank 17 to the printing head 2. A circuit R for the recirculation of the unused ink drops connects a collecting gutter 22 to the ink tank 17. Any device, known in the prior art, for the addition of fresh ink or solvent can be inserted into the printer. The printing head 2 is supplied with ink by the circuit A which comprises a pump 1, activated by a motor 7*m* and connected to the tank 17 by a conduit 31. This pump is designed to pressurize the ink coming out of the tank. This ink is then conveyed through a conduit 10 towards an accumulator 18, keeping the ink at constant pressure during the printing by the head 2. This ink may be filtered, by a filter 6 for example placed on the conduit 11 connecting the accumulator 18 to the head 2 before directly reaching the head 2. The printing head 2 sends out an ink jet 21 which, by means of appropriate stimulation, breaks up into ink drops which are then charged electrostatically in order to be deflected towards the medium to be printed on. The drops that have not been used for the printing and that have, therefore, not been deflected are collected in the gutter 22 placed beneath the ink jet. The collected ink must be conveyed up to the tank 17, by means of the circuit R.

This collecting circuit R has a conduit 220 connecting the outlet of the gutter 22, which is at atmospheric pressure, to the tank 17 which is at a lower pressure, the ink in the conduit 220 being placed in a depression state by suction means 23 for drawing or sucking in the air pocket that extends over the liquid ink in the tank 17. These means may be constituted by a pump, activated by a motor 23*m* and conducted to the air pocket of the tank 17 by a conduit 230 drawing in the air and sending it through a conduit 303 towards the exterior of the tank. Since the exterior of the tank 17 is at atmospheric pressure, means 23 creates a depression in the tank, which has an imperviously sealed lid 170.

The fluid conveyed in the conduit 220 is a two-phase mixture formed by ink collected from the gutter 22 and air carried along by the suction of ink in this same gutter. As a result, the losses of charge in the collecting conduit 220 result from the loss of charge which is a function of the liquid flow rate and from the loss of charge which is a function of the gas flow rate. These losses of charge are expressed by the difference between the atmospheric pressure prevailing in the gutter 22, upstream with respect to the conduit 220, and the pressure P prevailing in the tank 17, downstream with respect to said conduit 220. To dictate the flow rate of the liquid phase of this conveyed liquid, namely that of the ink, it is necessary to dictate a determined value of the pressure P in the tank 17, below the atmospheric pressure (this determined pressure value being hereinafter called a depression in the tank 17) in order to balance the losses of charge of the liquid and gas flow rates simultaneously.

Since this depression in the tank 17 is set up by the pump 23 which removes a certain quantity of air from the volume of the pocket located above the level of the ink in the tank 17, it can be controlled by action on the pump.

In the event of an increase in the losses of charge in the conduit 220, it is necessary to increase the depression in the tank to preserve the flow rate of the fluid flowing in the conduit 220. If it is not possible to increase the value of this depression beyond a value needed to balance the losses of charge, one of the fluid flow rates, the liquid flow rate or the gas flow rate, will diminish. No problems will arise so long as the flow rate of the liquid phase is sufficient for the ink to be discharged efficiently from the gutter 22 or from the conduit 220. The flow of each of the phases continues to behave substantially like an incompressible flow. The flow rate of the gas phase will be more accentuated than that of the liquid phase, for the minimum viscosity of the gas phase is lower than the minimum viscosity of the other phase. This phenomenon will give rise to an accumulation of liquid in at least one place in the gutter 22 or in the collecting conduit 220 and hence to a malfunctioning of the printer.

The invention proposes a method to optimize the operation of the printer, consisting in measuring the pressure P that prevails in the ink tank 17 by means of a pressure sensor 5, and in detecting any increase in losses of charge that results in an increase in the pressure P in the tank 17, i.e. a decrease in the depression in the conduit 220.

However, should the suction pump 23 be of the constant depression type (a turbine for example), then a problem will arise when the losses of charge increase in the conduit 220 and when the pump is unable to create a sufficient depression in the tank 17. The flow of the ink will decrease until the gas has a behavior which is predominantly that of a compressible fluid, finally stopping the flow of the ink which will collect in the conduit 220 up to the gutter 22, which risks overflowing in a catastrophic manner.

This is why the invention uses a constant flow pump which dictates a constant pumping rate for the extraction of air from the tank 17, but the pressure of which varies. Thus, when the losses of charge in the conduit increase, this prompts an increase of the depression in the tank 17, which can be detected by the sensor 5.

Subsequent to a problem of flow in the conduit 220, the increase in the depression in the tank 17, related to the extraction of air at a constant pumping rate, is not enough to solve the problem swiftly. To this end, there is a deliberate moving away from the operating point of the pump 23 through an increase in its suction speed, thus diminishing the pressure P in the tank 17 until the losses of charge in the conduit 220 are balanced again to the level needed to restore the ink flow rate.

When the flow rate has been established again, the proportion of liquid in the two-phase mixture of the ink will return to its initial value in the conduit 220 and the losses of charge will fall again. This will be expressed by an increase in the pressure P in the tank 17. Starting from this point, it will be possible for the suction speed of the pump 23 to be decreased.

Several methods may be implemented to achieve variations in the suction speed of a pump. It is possible to bring about variations in its cubic capacity, or variations in the rotational speed of its driving motor. In the case of a DC motor, the armature supply voltage of the inductor is made to vary. However, a variation of the excitation voltage is not appropriate because the pump must rotate at its maximum rotation speed while it gives a maximum depression. In the case of a stepping motor, the frequency of the supply voltage of the motor is made to vary but, correlatively, the current is increased at the same time as the frequency, for the torque required is an increasing function of the speed.

Figure 2:
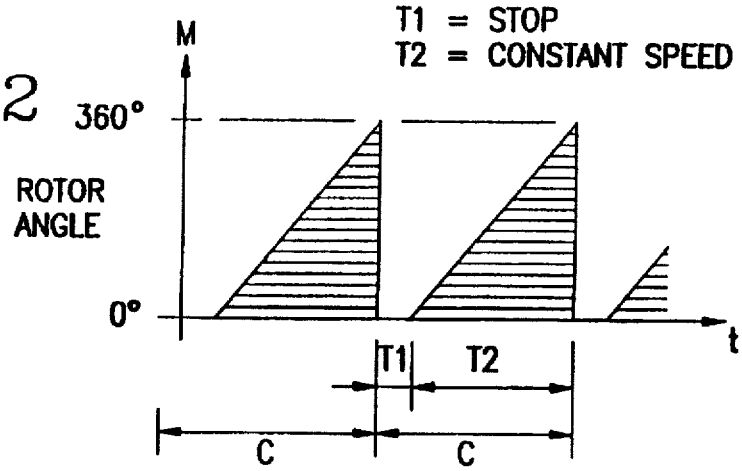
FIG. 2 is a time diagram of operation of a pump used according to the method of the invention.

According to another method that causes variation in the mean speed of the pump while preserving constant conditions of operation of the stepping motor, namely operation at constant frequency and current, the motor is stopped at each revolution. As can be seen in figure 2, the pump or the suction means 23 generally work periodically, it being possible for each period to be broken down into a period of time T1, during which the suction means 23 prompt no suction of air into the tank 17, and a period of time T2 of rotation at constant speed during which the suction means 23 prompt a suction. In the case of a constant flow pump that is rotationally driven by a motor, FIG. 2 shows the angle of rotation M of the motor, on the y axis, as a function of time, shown on the x axis. During a cycle C of revolution of the motor, an increase in the duration of the time T1 reduces the mean pumping rate of the pump, without any variation of the rotation speed of the driving motor, while a decrease in the duration of T1 increases the mean pumping rate of the pump. The electronic control circuit of the motor brings about variations in the periods of time T1 and T2 of the motor cycle and it checks the different parameters of the printer (pressure P read by the sensor 5, temperature T of the ink measured by a sensor 26) and controls other actuator units (solenoid valves 19 and 28 for example) during certain periods of non-suction T1 having a duration compatible with the measurements. Furthermore, using a software program that takes account of the pressure P in the tank 17 and other parameters, the circuit uses the non-suction time T1 to determine its duration before the motor is started again.

Irrespectively of the mode chosen to cause variations in the mean pumping rate of the constant flow pump 23, a decrease and, respectively, an increase in the mean pumping rate of the pump must subsequently be interpreted as a decrease in the mean speed of the driving motor or an increase in the stopping time at constant speed, and respectively as an increase in the mean speed of the motor or a decrease in the stopping time.

According to the invention, the printer will get set automatically at its optimum mode of operation for collecting the ink, considered as a two-phase mixture, according to the method described here below.

When the printer is started up, or in a reinitialization stage, in a first step, the suction means 23 work at their maximum suction rate, thus providing for a fluid rate of collecting the drops not used and collected in the gutter 22. The sensor 5 reads the pressure P in the tank 17 which is memorized as a value representing the accurate functioning of the collecting circuit R. Then, in a second step, the suction rate of the suction means 23 is gradually reduced in a gradient, by means of an increase in the duration of the non-suction time T1 in relation to the period of time T2, while the decreasing pressure P is measured, memorized and compared with a sliding mean of the last three previously measured values of pressure. There is thus defined a first range or interval of values of the pressure P indicating a fluid rate of collection of ink in the conduit 220. This step is achieved by the control circuit of the driving motor of the pump and continues until the depression in the tank 17 becomes incompatible with the last measured sliding mean value.

At this instant, the values of the temperature of the ink and pressure in the accumulator 18 are memorized for they represent the viscosity of the ink to be collected. Furthermore, the suction rate of the means 23 is memorized in the form of an image which, in the case of a pump, may be the mean rotation speed of its driving motor or the duration of the time T1, acquired at the last cycle for the reading of the pressure in the tank 17 by the sensor 5. This image is memorized as representing the minimum suction rate of the pump compatible with efficient collection of the ink in the gutter 22.

Then, in a third step, the suction rate of the means 23 returns immediately to its maximum value in reducing the duration of the time T1 to the minimum. This step can be carried out by the control device of the motor in the case of a constant flow pump. The duration of the time T1 is reduced to the minimum to increase the suction rate of the suction means 23, so long as the pressure P, measured in the tank 17, has not yet reached the value memorized at the starting point. Through renewed suction of a greater quantity of air into the tank 17, the right rate of collection of the ink will be restored with minimum losses of charge. The pressure P will increase to approach the atmospheric pressure. A second range of pressure values is then defined, separate from the first one, representing a fluid flow rate in the conduit 220, such that it is no longer possible to ensure efficient collection of the ink without the overflowing of the gutter 22.

In a fourth step, the duration of the non-suction time T1 is raised up to its last memorized value leading to a pressure P in the tank 17, again included in the first range of pressure values, with a margin of about 6% above this last memorized value.

After this automatic setting of the printer, its normal mode of operation takes place in the following two steps.

In a first step, the duration of the time T1 results from the value previously memorized by the printer in its starting phase and from the changes in temperature and viscosity of the ink during the printing. In a second step, activated by the detection of a decrease in the depression in the tank 17 incompatible with the efficient collection of the ink, the duration of the time T1 is reduced to its minimum value so long as the pressure P has not resumed its last memorized value providing for efficient collection.

Through experiments on a prototype printer according to the invention, it has been observed that a decrease (conversely an increase) in the temperature or an increase (conversely a decrease) in the instructed value or set value of pressure of the accumulator 18 implies an increase (conversely a decrease) in the rate of suction by the pump 23 to maintain efficient collection of the ink. As has already been described in the patents filed by the Applicant, the instructed value of pressure of the accumulator 18 influences the operation of the pump 1 for sending ink to the printing head. Indeed, the pressure in the accumulator increases with the viscosity of the ink, which is a decreasing function of the temperature. The greater the viscosity, the more difficult is it to achieve the flow of ink in the collecting conduit. This is why the method according to the invention correlates the suction rate of the pump 23 with the temperature, the instructed value of pressure of the accumulator 18 and the image of this suction rate described further above. The prediction of the behavior of the printer thus obtained makes it possible to avoid cases where the operation of the pump rises to its maximum rate because of drifts in the conditions external to the collecting circuit R.

What is claimed is:

1. A method to optimize operation of a deflected continuous flow ink-jet printer, the ink-jet printer comprising an ink supplying circuit for the supply of ink to at least one printing head and an ink collecting circuit for collection of ink not used for printing, said ink collecting circuit comprising a gutter, a conduit connecting the gutter to an imperviously sealed ink tank and suction means to draw in an air pocket extending above ink in said ink tank to set up a depression in the ink tank, said depression allowing suction, from the ink collecting circuit, of a two-phase mixture formed by ink collected from the gutter and air carried along by suction of ink in the gutter, wherein said method comprises:

firstly, checking a rate of collection of the ink by the following steps of:

measuring a pressure of the air pocket by means of a sensor, detecting a decrease in the pressure of the air pocket, which is indicative of an anomaly in the rate of collection of ink in said ink collecting circuit, the anomaly resulting in a lack of balance of losses of charge, in the conduit, between the ink flow and the air flow of the two-phase mixture;

secondly, controlling the operation of the suction means to be at a minimum suction rate compatible with a desired flow rate of ink in the conduit, and to be at a maximum suction rate when the anomaly is detected, the maximum suction rate allowing the losses of charge to be balanced.

2. A method according to claim 1, wherein said suction means working periodically in a plurality of periods, each period comprising:

a first period of time, called a non-suction period, during which said suction means causes no suction in the ink tank;

a second period of time, called a suction period, during which said suction means causes a suction in the ink tank at constant operating conditions; the suction rate of said suction means is adjusted by increasing the non-suction period in order to decrease the suction rate, and by decreasing the non-suction period in order to increase the suction rate.

3. A method according to claim 2, wherein controlling the operation of the suction means to be at a minimum suction rate compatible with a desired flow rate of ink in the circuit is done automatically, when the printer is started up and during stages of initialization of the printer, according to:

a first step during which said suction means operates at said maximum suction rate, and in which the pressure in the ink tank is measured and memorized;

a second step during which the suction rate of said suction means is decreased gradually according to a gradient, by an increase in duration of the non-suction period of time in the ink tank, the pressure in the ink tank being measured to provide pressure values which are memorized, the last pressure values measured giving a sliding mean of the pressure value, the second step being carried on until a pressure value is measured which is, when compared to the last sliding mean given, indicative of said anomaly, defining a first range of pressure values corresponding to a fluid rate of collection of the ink;

a third step during which said suction means is raised immediately to said maximum suction rate, by a reduction of the duration of the non-suction period of time, until the measured pressure again reaches its value memorized at the starting up of the printer, and defines a second range of pressure values, separate from the first one, corresponding to said anomaly in the collection of the ink;

a fourth step during which the duration of the non-suction period of time is raised up to a value ensuring a value of pressure included in the first defined range of pressure values, with a margin of 6% with respect to the value of the non-suction period of time still allowing a fluid rate of collection of the ink.

4. A method according to claim 3, comprising during a normal operation of the printer, a first step during which the duration of the time of non-suction by the suction means in the ink tank is fixed as a function of the value established in the fourth step, when the printer is started up, and of changes in temperature and viscosity of the ink during printing and a second step activated by the detection of a decrease of the pressure of said air pocket indicative of said anomaly, during which the non-suction period of time is reduced to allow said maximum suction rate until the pressure resumes its last memorized value providing for a desired flow rate of the ink in the conduit.

5. A method according to claim 4, wherein the duration of the non-suction period of time, fixed during said first step during a normal operation of the printer, increases if the pressure at a point of the circuit falls while the temperature of the ink rises.

6. A method according to claim 2 wherein, during the time of non-suction by said suction means, having a duration compatible with the pressure measurements, parameters of operation of the printer constituted by the pressure and the temperature of the ink are checked and a duration of the following non-suction periods of time is determined.

7. A method according to claim 6, wherein said suction means are comprised of a constant flow pump that is activated by an electronically controlled motor and that has a mean suction rate operable to vary from a minimum value when the rate of collection on the ink is the desired flow rate and to a value ensuring a depression in said air pocket restoring the rate of collection of the ink after said anomaly has been detected.

8. A method according to claim 7, wherein the pump has a suction rate varying as a function of the mean speed of a motor driving the pump.

9. A method according to claim 8, wherein the driving motor of the pump is of a stepping type pump with a plurality of cycles of revolution, with constant operating conditions, the control device of which causes the mean suction rate of the pump to vary by stopping of the motor at each cycle of revolution and by variation of stopping time in relation to time of rotation at constant speed at each cycle, the mean suction rate of the pump being decreased through an increase in duration of the stopping time, and this suction rate being conversely increased through, a decrease in said stopping time.

10. A deflected continuous flow ink-jet printer, the operation of said ink-jet printer being optimized by the method according to claim 1, the ink-jet printer comprising an ink supplying circuit for the supply of ink to at least one printing head and an ink collecting circuit for the collection of the ink not used in a printing operation, said ink collecting circuit comprising a gutter, a conduit connecting the gutter to an imperviously sealed ink tank and suction means to draw in an air pocket extending above the ink in said ink tank to set up a depression in the ink tank, said depression allowing the suction, from the ink collecting circuit, of a two-phase mixture formed by the ink collected from the gutter and air carried along by the suction of ink in said gutter.

11. A deflected continuous flow ink-jet printer, the operation of said ink-jet printer being optimized by the method according to claim 2, the ink-jet printer comprising an ink supplying circuit for the supply of ink to at least one printing head and an ink collecting circuit for the collection of the ink not used in a printing operation, said ink collecting circuit comprising a gutter, a conduit connecting the gutter to an imperviously sealed ink tank and suction means to draw in an air pocket extending above the ink in said ink tank to set up a depression in the ink tank, said depression allowing the suction, from the ink collecting circuit, of a two-phase mixture formed by the ink collected from the gutter and air carried along by the suction of ink in said gutter.

12. A deflected continuous flow ink-jet printer, the operation of said ink-jet printer being optimized by the method according to claim 6, the ink-jet printer comprising an ink supplying circuit for the supply of ink to at least one printing head and an ink collecting circuit for the collection of the ink not used in a printing operation, said ink collecting circuit comprising a gutter, a conduit connecting the gutter to an imperviously sealed ink tank and suction means to draw in an air pocket extending above the ink in said ink tank to set up a depression in the ink tank, said depression allowing the suction, from the ink collecting circuit, of a two-phase mixture formed by the ink collected from the gutter and air carried along by the suction of ink in said gutter.

13. A deflected continuous flow ink-jet printer, the operation of said ink-jet printer being optimized by the method according to claim 8, the ink-jet printer comprising an ink supplying circuit for the supply of ink to at least one printing head and an ink collecting circuit for the collection of the ink not used in a printing operation, said ink collecting circuit comprising a gutter, a conduit connecting the gutter to an imperviously sealed ink tank and suction means to draw in an air pocket extending above the ink in said ink tank to set up a depression in the ink tank, said depression allowing the suction, from the ink collecting circuit, of a two-phase mixture formed by the ink collected from the gutter and air carried along by the suction of ink in said gutter.

14. A method to optimize operation of a deflected continuous flow ink-jet printer, comprising a circuit for the supply of ink to at least one printing head and a circuit for collection of the ink not used for printing, comprising a gutter, a conduit connecting the gutter to an imperviously sealed ink tank by a conduit and suction means to draw in an air pocket extending above the ink to set up a depression in the ink tank, wherein said method comprises in carrying out, firstly, checking a rate of collection of the ink by the following steps of:

measuring pressure prevailing in the ink tank by means of a sensor;

detecting a decrease in the pressure in the ink tank, indicating an anomaly in the rate of collecting the ink;

and secondly, controlling the operation of the suction means to be at a suction rate to provide a flow rate of ink in the conduit and an increased suction rate when a decrease in the pressure of the ink tank indicates an anomaly in the rate of collecting the ink.

15. A method according to claim 14, wherein said suction means work periodically in a plurality of periods, each period comprising:

a period of time, called a non-suction period, during which said suction means cause no suction in the ink tank;

a second period of time, called a suction period, during which said suction means causes a suction in the ink tank at constant operating conditions, and the method further comprising adjusting a rate of suction of said suction means by changing duration of the non-suction period of time.

16. A method according to claim 15, wherein said controlling of the operation of the suction means is performed by controlling the operation of the suction means to be at a minimum suction rate compatible with a desired flow rate of ink in the conduit, and to be at a maximum suction rate when the anomaly is detected, the maximum suction rate allowing the losses of charge to be balanced.

17. A method according to claim 14, wherein said controlling of the operation of the suction means is performed by controlling the operation of the suction means to be at a minimum suction rate compatible with a desired flow rate of ink in the conduit, and to be at a maximum suction rate when the anomaly is detected.

18. A method to optimize operation of a deflected continuous flow ink-jet printer, comprising a circuit for the supply of ink to at least one printing head and a circuit for collection of the ink not used for printing, comprising a gutter, a conduit connecting the gutter to an imperviously sealed ink tank by a conduit and suction means to draw in an air pocket extending above the ink to set up a depression in the ink tank, wherein said method comprises in carrying out, firstly, checking a rate of collection of the ink by the following steps of:

measuring pressure prevailing in the ink tank by means of a sensor;

detecting a decrease in the pressure in the ink tank, indicating an anomaly in the rate of collecting the ink;

and secondly, controlling the operation of the suction means to be at a suction rate to provide a flow rate of ink in the conduit and an increased suction rate when a decrease in the pressure of the ink tank indicates an anomaly in the rate of collecting the ink, wherein said controlling of the operation of the suction means is performed by controlling the operation of the suction means to be at a minimum suction rate compatible with a desired flow rate of ink in the conduit, and to be at a maximum suction rate when the anomaly is detected, the maximum suction rate allowing the losses of charge to be balanced.

* * * * *